US007721651B2

(12) United States Patent
Lübbers et al.

(10) Patent No.: US 7,721,651 B2
(45) Date of Patent: May 25, 2010

(54) IRRITATION MEMBER

(75) Inventors: Thorsten Lübbers, Lütjensee (DE); Detlef Haeselich, Muessen (DE)

(73) Assignee: Rheimentall Waffe Munition GmbH, Trittau (DE)

( * ) Notice: Subject to any disclaimer, the term of this patent is extended or adjusted under 35 U.S.C. 154(b) by 0 days.

(21) Appl. No.: 11/883,473

(22) PCT Filed: Dec. 9, 2005

(86) PCT No.: PCT/DE2005/002221

§ 371 (c)(1),
(2), (4) Date: Feb. 25, 2008

(87) PCT Pub. No.: WO2006/063564

PCT Pub. Date: Jun. 22, 2006

(65) Prior Publication Data

US 2008/0276822 A1 Nov. 13, 2008

(30) Foreign Application Priority Data

Dec. 13, 2004 (DE) ..... 10 2004 059 991

(51) Int. Cl.
*F42B 8/00* (2006.01)

(52) U.S. Cl. ..... 102/498; 102/482; 102/483; 102/484; 102/485; 102/486; 102/487

(58) Field of Classification Search ..... None
See application file for complete search history.

(56) References Cited

U.S. PATENT DOCUMENTS

| | | | | |
|---|---|---|---|---|
| 5,654,523 | A * | 8/1997 | Brunn | 102/498 |
| 6,595,139 | B1 * | 7/2003 | Haeselich | 102/498 |
| 7,387,073 | B2 * | 6/2008 | Bodley et al. | 102/498 |
| 2006/0283346 | A1 * | 12/2006 | Luebbers et al. | 102/487 |

FOREIGN PATENT DOCUMENTS

| | | |
|---|---|---|
| WO | WO 94/08200 | 4/1994 |

* cited by examiner

*Primary Examiner*—Troy Chambers
*Assistant Examiner*—Samir Abdosh
(74) *Attorney, Agent, or Firm*—Karl F. Milde, Jr.; Eckert, Seamans, Cherin & Mellott, LLC

(57) ABSTRACT

Disclosed is an irritation grenade (1) comprising a receptacle (2) with at least one compartment (12) within which an effective charge (3) is accommodated and which ends in one respective discharge port (21, 22) on opposite sides of the receptacle (2) while being locked by means of a closure (15). A rocker-arm type igniter (4) is provided to ignite the effective charges. The combustion gases of the effective charges (3) are deflected in part by parts of the rocker-arm igniter (4) such that the irritation grenade is displaced when the effective charges (3) are ignited. In order to prevent this from happening, the cross section of the discharge ports (21, 22) of the compartments (12) is embodied smaller on the side opposite the rocker-arm igniter (4) than the cross section of the discharge ports (21) on the side of the rocker-arm igniter (4) such that recoil forces which are generated when the effective charges (3) are burned and act upon the irritation grenade (1) are substantially identical on both opposite sides.

4 Claims, 1 Drawing Sheet

1

IRRITATION MEMBER

BACKGROUND OF THE INVENTION

The invention relates to an irritation grenade to create irritation or shock to a human being.

Among other things, irritation grenades are used in hostage situations or aircraft hijackings in order to overpower the perpetrators. The irritation grenade is mainly in the form of a hand grenade with a preferably cylindrical receptacle that possesses at least one, and preferably several, chambers, e.g., drilled holes, extending parallel to the longitudinal axis and occupying the entire length of the receptacle. Said chambers contain active or effective charges such as sound or flash loads. A manually-operable igniter, usually a rocker-arm igniter, ignites a pyrotechnic delay charge that ignites the individual effect charges via ignition channels. These charges create a shock effect such as, for example, a very loud noise, a blinding flash, or similar, achieving an irritation or shock effect to the perpetrator and allowing him to be captured.

An irritation grenade of the type discussed above is known from WO 94/08200 in which a total of six compartments that transfix the entire length of the irritation grenade are positioned about the central axis of the irritation grenade and that are sealed by plugs at the upper and lower end, into which the particular effect charge is placed. Upon ignition of the effect charges the plugs are instantly ejected by the increasing inner pressure within the compartments, after which the combustion gases exit upward and downward from the receptacle via the now opened discharge ports. During this, recoil acting on the irritation grenade in opposing directions should be canceled out. It has been nevertheless shown, that after ignition of an effective charge, the irritation grenade may be displaced by several meters. Such an uncontrolled displacement presents the hazard of injury for any persons in the vicinity, particularly with those irritation grenades with several time-offset effects, but not only with them.

SUMMARY OF THE INVENTION

It is an object of the invention to prevent displacement after the ignition of individual effect charges, so that the irritation grenade remains in essentially the same place after striking the floor, thus not injuring bystanders by means of its displacement.

It has turned out that displacement of the irritation grenade after ignition of the effective charge is essentially caused by the fact that parts of the rocker-arm igniter extend into the stream of the combustion gases of the effective charges, and modify the recoil caused by the combustion gases on the irritation grenade.

This may be avoided per the invention in a simple manner in that the cross section of the discharge ports of the compartments at the end of the plug side opposite the igniter be made smaller than the cross section of the discharge ports on the igniter end. The ratio of discharge ports is so selected that recoil forces arising from the combustion of the effective charges act on both opposite sides of the irritation grenade essentially equally.

The compartments of the irritation grenade are preferably stepped drilled holes to accept the effective charges, whereby the step on the floor of the irritation grenade is provided, thus reducing the cross section of the hole there.

The ratio of cross sections of the discharge ports at opposite ends of the irritation grenade need not be the same for all compartments since the streams of combustion gases may be influenced differently from different compartments through the igniter. In order to achieve essentially complete balance of recoil forces in such a case, it must be ensured that the igniter is always mounted to the receptacle of the irritation grenade at the same angle.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
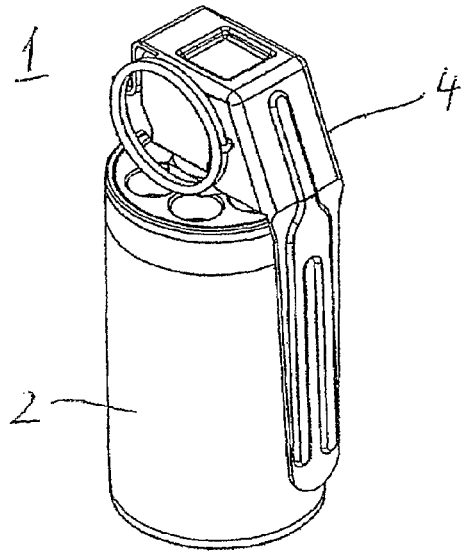
FIG. 1 is a perspective view of an irritation grenade based on the invention at an approximate scale of 1:1.

The preferred embodiments of the present invention will now be described with reference to FIGS. 1 and 2 of the drawings. Identical elements in the figures are designated with the same reference numerals.

An irritation grenade 1 includes a cylindrical receptacle 2 to accept several effective loads 3 and a rocker-arm igniter 4 mounted on the upper face of the receptacle 2 as shown in FIG. 1.

Figure 2:
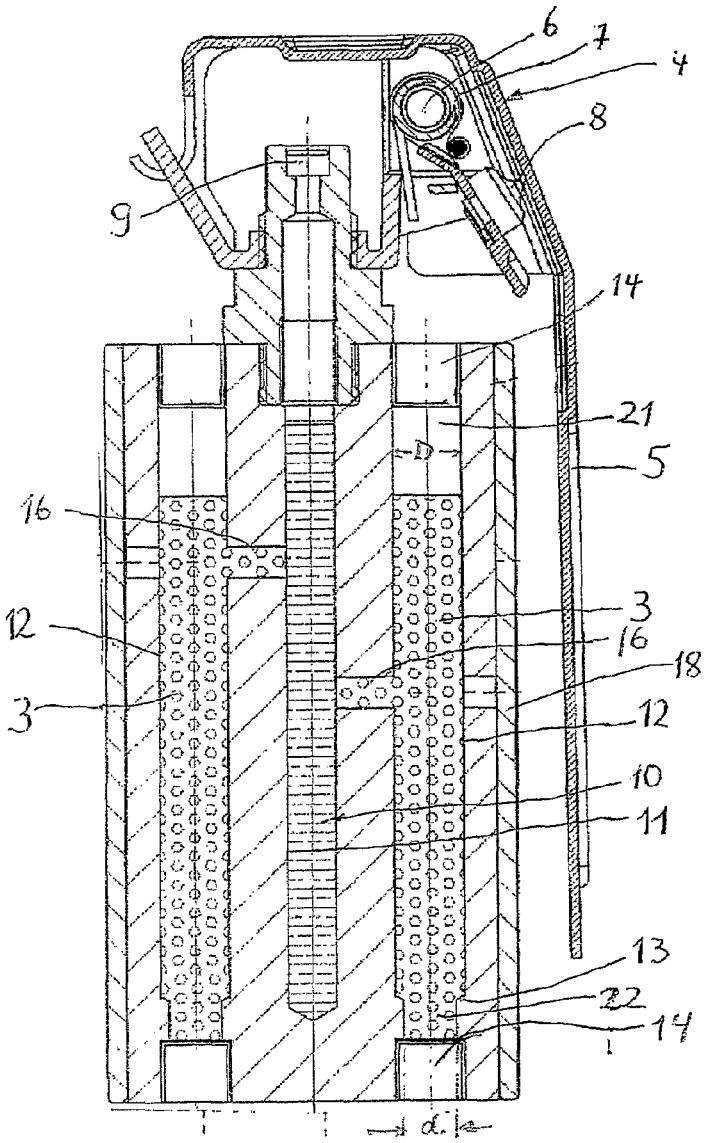
FIG. 2 is a longitudinal cutaway view through the irritation grenade in FIG. 1.

The rocker-arm igniter 4 is provided with a handgrip 5 extending almost the entire length of the receptacle 2 that may be very rapidly pivoted upward about a horizontal axis 6 above the top face of the receptacle 2 with the help of a strong pre-tensioned spring 7 as shown in FIG. 2. The handgrip 5 is usually secured using a securing pin (not shown), and is thus held in the initial position shown in FIG. 2. If the irritation grenade is used, the securing pin is removed, whereby the handgrip is held in its initial position by the user.

The rocker-arm igniter includes a striking pin that is moved by the spring 7 along with the handgrip 5 when it is released, and that subsequently strikes a centrally-positioned ignition cap 9, igniting its charge.

From this central ignition cap 9, a central blind hole extends along the middle axis in which a delay charge 11 is placed, ending approximately in the vicinity of the floor of the receptacle 2.

Around the central drilled hole 10 compartments or chambers are positioned parallel into which the above-mentioned effective charges 3 are placed. Each of the chambers 12 is a stepped drilled hole that extends for the entire length of the receptacle 2, and each possesses a step 13 near its floor that reduces the cross section of the chamber.

Each chamber 12 is sealed at its end on the opposite face of the receptacle 2 by a plug 14 or similar.

Ignition transfer channels 16 lead from the central chamber 10 to the individual chambers 12, whereby these ignition transfer channels are drilled from the outside and the outer openings are subsequently sealed, e.g., by a jacket 18 on the mantle surface of the grenade.

Function of the irritation grenade is as follows:

After release of the above-mentioned security pin for the handgrip 5 and while holding the irritation grenade 1 in the hand by the handgrip, the irritation grenade 1 is thrown in the direction of a perpetrator to be irritated. When the irritation grenade is released, the striking pin 8 strikes the igniter cap 9, igniting its charge. This charge in turn ignites the delay charge 11 within the central chamber 10. The delay charge 11 combusts at a predetermined speed. As soon as the flame front reaches a ignition transfer channel for a chamber 12, the effective charge 3 within the chamber is ignited. Various effects are created by the position of the ignition transfer channels 16 in the direction of the central axis of the irritation grenade: for example, the effective charges may be ignited in all chambers simultaneously or sequentially, whereby intermediary actions are possible.

The design of the individual chambers 12 as stepped drilled holes with a diameter D and a reduced diameter d through step 13 allows the chambers 12 to have an discharge port 21 on the side facing the rocker-arm igniter 4 with a diameter D and a discharge port 22 on the bottom side with a diameter d. The two diameters D and d are so matched to each other that the recoil impulse created by the discharged combustion gases from the effective charges 3 is the same in both directions. After the plug 14 is expelled by the inner pressure within the chambers 12 upon combustion of the effective charges 3, impulses or recoil forces of equal magnitude are exerted on the irritation grenade in both directions so that it remains in one place and is not displaced.

It is clear that the diameter or general cross section of the discharge ports 21, 22 of different chambers 12 may also be dimensioned differently in order to balance the disruptions caused by the rocker-arm igniter individually.

There has thus been shown and described a novel irritation grenade which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An irritation grenade for causing an irritation or shock effect on a human being, comprising (a) a substantially cylindrical receptacle that includes at least two compartments parallel to a central middle axis of the receptacle and transfixing the receptacle, whereby an effective charge is placed into the compartments, the compartments ending on opposite sides of the receptacle in upper and lower discharge ports, respectively, which are sealed with a closure, and (b) a manually-operated rocker-arm igniter mounted on one of the opposite sides of the receptacle, wherein a cross section of the discharge ports of the compartments opposite to the rocker-arm igniter is smaller than a cross section of the discharge ports on the side with the igniter, such that recoil forces on the irritation grenade created by combustion of the effective charges are essentially equalized.

2. Irritation grenade as in claim 1, wherein the compartments for the effective charges are stepped drilled holes with a step reducing the diameter of each hold at the end opposite the igniter, forming a discharge port with reduced cross section.

3. Irritation grenade as in claim 1, wherein the cross sections of individual discharge ports of individual compartments are dimensioned individually.

4. Irritation grenade as in claim 1, wherein the receptacle includes a central chamber to accept a delay charge ignitable by the igniter device, and wherein ignition transfer channels are provided from the central chamber to individual compartments for individual effective charges.

* * * * *